United States Patent [19]

Harris et al.

[11] 4,370,164

[45] Jan. 25, 1983

[54] YELLOW METAL ALLOY

[75] Inventors: William R. Harris, Edina; Harold G. Jache, Owatonna, both of Minn.

[73] Assignee: Jostens Inc., Minneapolis, Minn.

[21] Appl. No.: 222,152

[22] Filed: Jan. 2, 1981

[51] Int. Cl.[3] ..... C22C 5/06

[52] U.S. Cl. ..... 420/503

[58] Field of Search ..... 75/173 R, 173 A, 173 C, 75/134 B, 134 T, 134 P, 134 C; 433/228, 229

[56] References Cited

U.S. PATENT DOCUMENTS

| | | | |
|---|---|---|---|
| 2,058,857 | 10/1936 | Emmert | 75/173 R |
| 2,151,905 | 3/1939 | Hensel | 75/173 R |
| 2,157,933 | 5/1939 | Hensel et al. | 75/173 R |
| 2,161,574 | 6/1939 | Hensel et al. | 75/173 R |
| 2,180,827 | 11/1939 | Hensel et al. | 75/173 R |
| 2,189,756 | 2/1940 | Hensel | 75/173 R |
| 2,195,307 | 3/1940 | Hensel et al. | 75/173 R |
| 2,221,286 | 11/1940 | Hensel et al. | 75/173 R |
| 3,661,569 | 5/1972 | Abbott | 75/134 T |
| 4,052,531 | 10/1977 | Steine et al. | 75/134 T |

FOREIGN PATENT DOCUMENTS

| | | | |
|---|---|---|---|
| 782307 | 9/1957 | United Kingdom | 75/173 R |

*Primary Examiner*—John P. Sheehan

*Attorney, Agent, or Firm*—Schroeder, Siegfried, Vidas, Steffey & Arrett

[57] ABSTRACT

An alloy of about 4 to 10% gold, silver, copper, palladium, indium, zinc and boron producing an alloy with a pleasing yellow color. Tarnish resistance, wear resistance and heft are similar to 10 karat gold with a lesser cost due to the low gold content.

8 Claims, No Drawings

YELLOW METAL ALLOY

DESCRIPTION

BACKGROUND OF INVENTION

The present invention is directed to a new alloy composition which combines essentially all of the advantages of expensive jewelry alloys such as 10 karat gold without the high cost of such materials.

With the rising costs of gold and other precious metals, it is highly desirable to have available alloys which make use of as low quantities of these precious metals as possible, while retaining their highly desirable appearance, tarnish resistance and wear resistance. Even with alloys as low in gold content as 6 karat, the current costs of gold in such alloys is well in excess of $125 an ounce. Through the forming of a new alloy in accordance with the present invention, this cost is markedly reduced, as the new alloys have a gold content of only 1.5 karat, while retaining essentially all of the desirable characteristics of the higher gold content alloys.

DESCRIPTION OF THE INVENTION

In accordance with the present invention, a metal alloy is provided consisting essentially of 4% to 10% gold, 54% to 61% silver, 14% to 19% copper, 4% to 7% palladium, 9% to 14% indium, 1% to 3% zinc and 0.015% to 0.04% boron. When percentages are used herein, it will be understood that it is intended to mean percent by weight to total composition.

A preferred alloy will consist of 7.14% gold, 58.45% silver, 15.88% copper, 5% palladium, 12% indium, 1.5% zinc and 0.03% boron. The alloys in accordance with the invention have a unique yellow color which is attractive although slightly less yellow than that of 10 karat gold. Tarnish resistance to normal tarnishing agents, such as hydrogen sulfide gas, sulfer dioxide gas and carbon dioxide gas at 100% humidity is equivalent to or exceeds that of 10 karat gold. The preferred alloy has a very high resistance to stress corrosion, substantially higher than 10 karat gold. This benefit applies to uses where there is expected that contact with household chemicals will take place; especially chlorine based cleaners and bleach, acidic foods and kitchen chemicals. The specific gravity is 10.01 in comparison to 10 karat gold at 11.39. This results in the preferred heavy "feel" of 10 karat gold which other low precious metal content alloys and other yellow color base metals lack.

The hardness, ductility and tensile strength, when formed in accordance with the procedure outlined below, will be as follows:

| | |
|---|---|
| Average hardness | 73.5 RB |
| Average tensile strength | 67,600 PSI |
| Average elongation (in 1 inch) | 31.79% |

Within the range of the invention, when the gold content is decreased and the indium content is increased from the preferred formula, the color is slightly less yellow and the alloy is slightly less resistant to tarnish and is less ductile.

An increase of gold content and a decrease of indium content from the preferred formula results in an alloy with essentially the same color but reduced ductility and tensile strength. The price of the finished alloy is higher as the gold content increases, with no distinct advantage in increasing the gold content beyond the 7% range.

An increase of indium beyond the 14% range reduces the melting point, reduces hardness and ductility and causes difficulty in alloying.

A reduction of gold content below the 4% range results in a relatively brittle alloy with poor resistance to tarnish.

The alloys of the invention have been found to be particularly suitable for investment casting of jewelry as they hold very good depth tolerance and uniformity of composition provided the bulk alloy material is manufactured by the following procedure. If the procedure is not followed, the lower melting temperature elements may be violatized and lost with possible precipitation of boron inclusions at the casting surface as an undesirable surface defect.

The alloys of this invention also possess utility in dentistry for dental prosthesis.

ALLOY PREPARATION

In manufacturing the bulk alloy material, it is desirable to use a copper, boron, silver alloy as a source for boron to be incorporated into the final alloy. It has been found that a useful alloy for this purpose is an alloy of 47.41% copper, 52.5% silver and 0.09% boron. This alloy is prepared by heating the elements to a temperature of 1925° to 1950° F. in a clay graphite crucible and poured into a casting grain form.

The finished alloy is prepared by preheating a clay graphite crucible to 800°–1000° F. It is then removed from the heat source. The crucible is charged with the indium, zinc and copper-silver boron master alloy in that order. This prevents the indium and zinc from volatizing. Silver is then added with approximately one ounce of sodium pyroborate as flux. The crucible is returned to the heat source and heated to a temperature of 1450° F. and mixed to homogenize. While continuing to heat, gold and palladium are added, in that order with mixing to homogenize. The alloy is poured through a heated strainer crucible to create casting grain when the temperature reaches 1650° F.

High quality investment castings can be manufactured by heating the alloy grain to a temperature of 1650° to 1675° F. and pouring into a prepared investment flask at a temperature not to exceed 925° F. The investment flask should be at least 875° F.

We claim:

1. An alloy consisting essentially of 4% to 10% by weight gold, 54% to 61% by weight silver, 14% to 19% by weight copper, 4% to 7% by weight palladium, 9% to 14% by weight indium, 1% to 3% by weight zinc and 0.015% to 0.04% by weight boron.

2. An alloy in accordance with claim 1 wherein gold is about 7.14% by weight, silver is about 58.45% by weight, copper is about 15.88% by weight, palladium is about 5% by weight, indium is about 12% by weight, zinc is about 1.5% by weight and boron is about 0.03% by weight.

3. Metal articles which in their normal use are subject to tarnish, stress corrosion and are yellow in color composed of the alloy in accordance with claim 1.

4. Metal articles which in their normal use are subject to tarnish, stress corrosion and are yellow in color composed of the alloy in accordance with claim 2.

5. An article of jewelry formed of an alloy in accordance with claim 1.

6. An article of dental prothesis formed of an alloy in accordance with claim 1.

7. An article of jewelry formed of an alloy in accordance with claim 2.

8. An article of dental prothesis formed of the alloy of claim 2.

* * * * *